United States Patent [19]

Richards

[11] Patent Number: 4,651,836

[45] Date of Patent: Mar. 24, 1987

[54] PROCESS FOR RECOVERING METHANE GAS FROM SUBTERRANEAN COALSEAMS

[75] Inventor: Walter L. Richards, Huntington Beach, Calif.

[73] Assignee: Methane Drainage Ventures, Placentia, Calif.

[21] Appl. No.: 846,954

[22] Filed: Apr. 1, 1986

[51] Int. Cl.[4] ..... E21B 21/06; E21B 33/138; E21F 5/00

[52] U.S. Cl. ..... 175/62; 166/50; 175/66; 175/72; 299/12

[58] Field of Search ..... 175/62, 65, 66, 72; 299/12; 166/50

[56] References Cited

U.S. PATENT DOCUMENTS

| | | | |
|---|---|---|---|
| 2,245,886 | 6/1941 | Weir et al. | 175/65 X |
| 3,011,567 | 12/1961 | Turner | 175/62 X |
| 4,043,136 | 8/1977 | Cherrington | 175/72 X |
| 4,245,699 | 1/1981 | Steeman | 299/12 X |
| 4,273,193 | 6/1981 | Tumpkins | 175/62 X |
| 4,303,274 | 12/1981 | Thakur | 299/12 |
| 4,317,492 | 3/1982 | Summers et al. | 175/62 X |
| 4,445,574 | 5/1984 | Vann | 175/62 X |
| 4,452,489 | 6/1984 | Richards | 299/12 X |
| 4,461,359 | 7/1984 | Jones, Jr. et al. | 175/62 X |
| 4,544,208 | 10/1985 | Miller | 299/12 |

*Primary Examiner*—George A. Suchfield
*Attorney, Agent, or Firm*—Walter A. Hackler

[57] ABSTRACT

A process provides for the recovering of methane gas from subterranean coalseams having sloughing, or caving, characteristics. A borehole is drilled in a generally horizontal direction into a subterranean coalseam and as the drilling progresses, a flushable borehole cake is formed on and in the walls of the horizontal borehole. The borehole cake prevents contemporaneously sloughing, or caving, of the boreholes during the drilling operation. A perforated liner may be inserted into the horizontal borehole and the borehole cake is then flushed out in order to allow methane gas present in the coalseam to enter the liner from which it is collected.

27 Claims, 5 Drawing Figures

PROCESS FOR RECOVERING METHANE GAS FROM SUBTERRANEAN COALSEAMS

The present invention is directed to the recovery of methane gas from subterranean coalseams and, more particularly, directed to a process utilizing horizontally drilled boreholes in coalseams which have caving, or sloughing, characteristics.

It is known that horizontal boreholes are an effective method of draining methane gas from subterranean coalseams, either in advance of mining the coalseams, or for independent commercial production of methane gas.

While such horizontal boreholes may be drilled in a conventional manner in many coalseams, such boreholes have not been successfully drilled in caving, or sloughing, coalseams. As the name implies, caving, or sloughing, coalseams are those in which the integrity of the coal formation therein is insufficient to maintain a consistant borehole wall during the drilling operation or thereafter.

It should be obvious that borehole caving, or sloughing, may either totally occlude, or restrict, the borehole thereby either terminating or severally limiting the amount of methane gas that the horizontal borehole would otherwise produce.

Heretofore, little, if any, successful horizontal borehole drilling has been accomplished in caving, or sloughing, coalseams, Some attempts have been made, as for example set forth in U.S. Pat. No. 4,544,208 to Miller, wherein a propping agent such as sand is forced into the borehole walls in order to reduce sloughing thereof. This has the disadvantage of filling the very cracks and pores from which the methane gas is to escape.

It must be appreciated that most, if not all, horizontal boreholes drilled for the recovery of methane gas are drilled from underground workings or shafts. With this in mind, it must be appreciated that the physical size of the equipment utilized in such drilling is restricted by the ordinary confines defined by a typical mining operation. Hence. large drill machines are not economically feasible, or practical, in such environs.

The efficiency of recovery of gas through horizontal boreholes is related to the length of such boreholes. It is evident that the longer the borehole within the coalseam, the greater exposed area for collection and the greater volume of methane produced per borehole.

While other factors may limit the production of methane gas, such as the amount of methane in the coalseam, the porosity and permeability of the coalseam and the effective pressure of the methane gas within the coalseam, these factors play a minor role if the borehole cannot be maintained in an open or unrestricted condition for the passage of methane gas therethrough.

It has been found that desirable horizontal boreholes, effective for the collection of methane gas, are measured in terms of thousands of feet in length.

Conventional procedures for such drilling is to use a drag bit, or the like, which is suitable for boring in soft formations, such as coalseams, and to remove the cuttings generated thereby by flushing the borehole during drilling with available water and additives to control foaming.

This flushing of fluid is effective in carrying the cuttings from the borehole, however, it is insufficient to carry out significant portions of the borehole wall which may slough, or cave in, during the drilling procedures.

Hence, there is a need for a process for recovering methane gas from subterranean coalseams having sloughing, or caving, characteristics.

The present invention includes a process for such recovery. An advantage of the present invention is the process of stabilizing borehole walls during the drilling of long horizontal holes, while at the same time providing for substantially unrestricted flow of methane gas from the drilled horizontal borehole during the methane production period of the process of the present invention.

It should be appreciated that heretofore not only were drilling fluids incapable of removing coal produced by sloughing and caving of the boreholes, but in fact contributed to such sloughing and caving in of the boreholes, due to the erosion effects of the fluids circulated through the borehole.

It should also be recognized that not only does such sloughing and caving of the borehole occur during the drilling operation, but subsequent to the drilling and removal of the drill steel and bit as well. Hence, a conventional borehole is continually being filled by sloughing and caving of the borehole walls as the earth settles thereabout. While this subsequent sloughing and caving in is not significant in many coalseams, in others the borehole may be filled within a short period of time, therby rendering the borehole unproductive for the recovery of methane gas.

Therefore, in order to recover gas from coalseams having sloughing, or caving, characteristics, not only is it necessary to restrict or eliminate the amount of sloughing and caving during the drilling operation, but to prevent subsequent sloughing, or caving, from filling the borehole, thus rendering it unproductive for the collection of methane gas after the drilling has been completed.

The present invention includes process by which long horizontal boreholes can be drilled in sloughing and caving coalseams which includes the preventing of such sloughing and caving during the drilling operation itself and further provides for maintaining a substantially open borehole suitable for the collection of methane gas subsequent to the drilling operation which is not significantly affected by settling of the coalseams and continued sloughing and caving of the drilled borehole.

SUMMARY OF THE INVENTION

The process for recovering methane gas from subterranean coalseams having sloughing, or caving, characteristics, in accordance with the present invention, includes the steps of drilling generally horizontal boreholes into a subterranean coalseam and as drilling progresses, forming a flushable borehole cake on and in the walls of the horizontal borehole.

In this fashion, the borehole cake prevents contemporaneous sloughing, or caving, of the borehole wall during the drilling operation.

The borehole cake is then flushed out of the horizontal borehole to allow the methane gas present in the coalseam to enter the borehole from which it is collected. A perforated liner may be used for this flushing procedure.

It is apparent that the perforated liner can maintain the integrity of the borehole despite sloughing, or caving, of the original borehole walls thereonto. Further, the perforations in the liner enable methane gas in the coal formation to flow into the liner.

In fact, subsequent sloughing of the borehole wall onto the liner further separates any remaining borehole cake, enabling the methane gas to flow therethrough into the liner.

More particularly, the flushable borehole cake is formed by pumping a slurry comprising mud solids and water into the borehole as drilling progresses, with a temporary mud cake being formed as the mud solids are deposited on and in the horizontal borehole wall as the water seeps into the horizontal borehole wall.

The temporary mud cake also enables the drill rod to be removed without significant sloughing and thereby enables the perforated liner to be inserted to the full length of the borehole.

It has been found that for use with the drilling of horizontal boreholes in coalseams, the mud solids may comprise Bentonite and, further, the slurry of Bentonite and water may be pumped into the borehole in sufficient quantity to provide lubrication for the drilling process, as well as carry the cuttings, created by the drilling, from the horizontal borehole, in the form of an efflux having a total solids content comprising cuttings and solid muds.

Since the mud solids are deposited on and in the boreholes to form a cake thereon, the efflux contains less Bentonite than the slurry pumped into the borehole. Hence, an additional step in accordance with the present invention includes that of removing the cuttings from the efflux and adjusting the total solids content therein to preselected levels to form a recycled slurry and pumping the recycled slurry into the horizontal borehole.

With regard to the step of adjusting the total solids contents and the efflux, the recycled slurry, in accordance with the present invention, is adjusted to a preselected level of between about 5 percent by weight and about 25 percent and preferably below about 10 percent by weight. In this manner, the mud solids content of the recycled efflux is adjusted to enable sufficient mud cake buildup in and on the horizontal borehole walls to prevent significant sloughing, or caving in.

Correspondingly, the solids content of the slurry pumped down the borehole during drilling is adjusted so that the slurry has the viscosity of between about 40 cP and about 60 cP.

After the drilling has progressed a significant distance, the viscosity of the slurry is lowered and defloculant, such as sodium acid pyrophosphate, may be added.

The lowering of the slurry viscosity and addition of a defloculant may be utilized in order to prevent the drill cuttings from bridging in an annulus defined by the drill shaft and the horizontal boreholes as may occur in long boreholes. This bridging obviously inhibits free circulation of the slurry.

The process steps of adjusting slurry viscosity and addition of additives occur in response to the drilling conditions encountered, which, of course, are dictated by the sloughing and caving characteristics of the coalseams.

Hence, the length of the borehole at which these steps are implemented is determined by the characteristics of each coalseam formation.

Upon completion of drilling the borehole, the perforated liner is inserted into the borehole. As hereinbefore mentioned, the temporary mud cake can facilitate the installation, or insertion, of the liner.

After insertion of the perforated liner, the borehole may be flushed with water to remove the temporary cake on and in the horizontal borehole walls. The water may be carbonated and/or may include a dilute acid and a foaming agent in order to facilitate the removal of the temporary borehole cake.

The present invention also provides a process for forming a generally horizontal borehole into a subterranean coal seam which includes the steps of drilling a generally horizontal borehole into the subterranean coalseam, forming a flushable borehole cake on and in the wall of the horizontal borehole as it is drilled and flushing the flushable borehole cake out of the horizontal borehole after drilling is completed. In this manner, a relatively clean unoccluded borehole may be provided than would be possible in coalseams having sloughing, or caving, characteristics.

BRIEF DESCRIPTION OF THE DRAWINGS

The advantages and features of the present invention will appear from the following description when considered in conjunction with the accompanying drawings in which.

DETAILED DESCRIPTION

Figure 1:
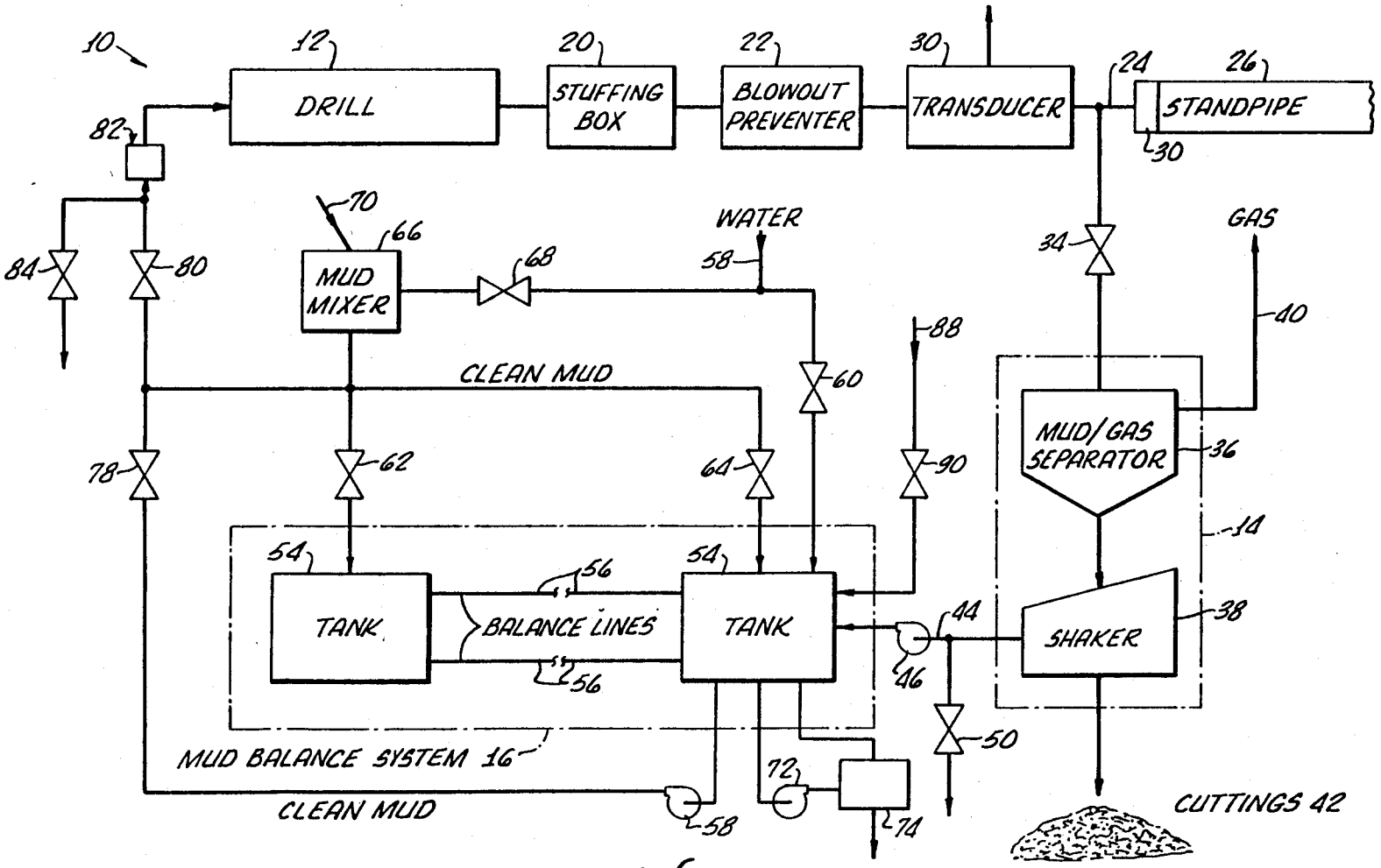
FIG. 1, is a schematic diagram of equipment for performing the process of the present invention generally showing a drill and associated equipment for forming a flushable borehole cake on and in the wall of the horizontal borehole as it is drilled.

Turning to FIG. 1, there is shown apparatus 10 suitable for performing the process of the present invention and generally includes a drill 12, a separator system 14, and a mud balance system 16.

More particularly, the drill 12 may be of any suitable type for drilling horizontal holes in subterranean shafts and workings in coalseams which is interconnected with a drill bit, not shown, by a drill pipe 24 extending through a conventional stuffing box 20, blowout preventer 22, and standpipe 26.

As schematically shown in FIG. 1, standpipe sensors 30 may be provided for monitoring the pressure of the fluids pumped into and returning from the standpipe in order to evaluate the drilling process and provide information with regard to the balance of mud and water in the drilling fluid, which may be later used to adjust the content thereof in recycled slurry as will be hereinafter described in greater detail. The sensors 30 may also be used for survey systems or borehole control.

Efflux from the borehole is conducted through a valve 34 to the separation system, with the latter consisting of a conventional mud gas separator 36 and a solid separator, or shaker, 38.

Gas is collected through a vent 40 and cuttings 42 disposed of while the remaining efflux, which may contain fine cuttings, is passed to the mud balance system via a conduit 44 and a pump 46.

It should be appreciated that while a limited number of pumps 46 and 48 are shown in FIG. 1 in diagrammatic form, it is to be appreciated that the number and placement of pumps in the system and other cleaning and monitoring equipment (not shown) may be of any configuration suitable for transporting and cleaning the fluids handled by the system as generally indicated in the diagram of FIG. 1.

A sampling valve of 50 may be provided in order to monitor the solids liquid character and content in the efflux provided to the mud balance system.

The mud balance system generally consists of a plurality of tanks 54, only two shown in FIG. 1 for the sake of brevity, which are interconnected by balance lines 56 for circulating the efflux therebetween.

Additional water may be added to the mud balance system 16 through an inlet 58 and valve 60 into the tank 54. Accordingly, clean mud, which may be Bentonite, as hereinafter described, may be introduced into the tanks 54 via valves 62, 64 which is obtained via a conventional mud mixer 66 utilizing water, or recycled mud, through a valve 68 and dry mud from an intake 70. A pump 72 may be used to feed mud through a hydroclone 74 in order to clean fine cuttings (not shown) from the mud.

The pump 58 supplies the balanced mud through valves 78, 80 to the drill 12 via a flowmeter 82 with the recycled efflux passing through the drill pipe down into the borehole. A sampling valve 84 may be provided to monitor a solids liquids content of the recycled efflux to ensure that proper mud water balances exist and the viscosity is suitable for the drilling operation.

It has been found that the mud balance system must be adjusted throughout the drilling procedure, particularly as the length of the hole increases. For example, as will be hereinafter described in greater detail, the mud solids content is significantly reduced and the viscosity of the recycled slurry is significantly reduced as the drilling progresses while additional defloculant or anticoagulant additives are included, which are added to the recycled slurry into the mud balance system 16 via an additive inlet 88 and valve 90.

Figure 2:
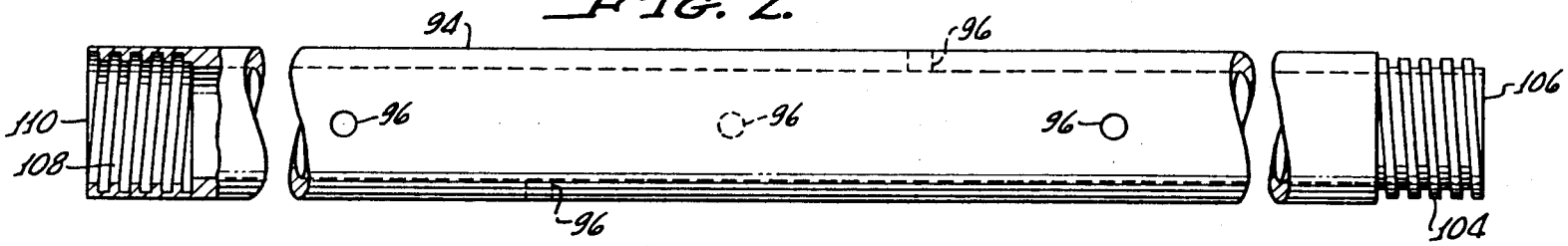
FIG. 2, is a plan view of a perforated liner for use in the process of the present invention.
Figure 3:
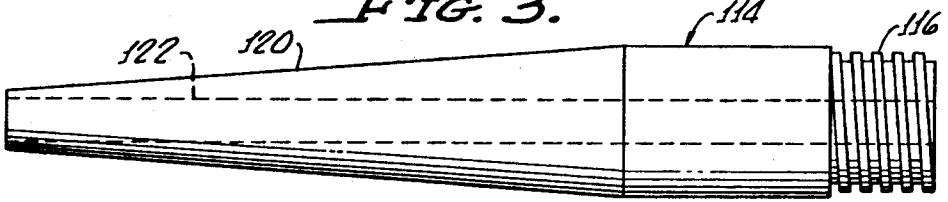
FIG. 3, is a plan view of a guiding shoe useful for inserting the perforated liner into a drilled horizontal borehole.

A liner suitable for process of the present invention may be formed of a two inch, or any other suitable size, plastic PVC pipe and schedule 80 and 94 with about 9/16 inch holes 96, drilled therealong which are rotated with respect to one another 90 degrees as is illustrated in FIG. 2. Spacing between adjacent holes 96 may be approximately 6 inches.

In order to provide a flush outside surface for the liner which preferably is made in 10 foot sections, external threads 104 formed on one end 106 of each pipe section 94 are sized and designed for engaging internal threads 108 on another end 110 of each liner 94.

The number and spacing of the holes 96 must be sufficient to allow methane gas to enter the liner 94 therethrough without seriously damaging the integrity of the liner from a strength standpoint so that it may be inserted into the borehole. Although shown in the form of holes, it should be appreciated that other types of openings, such as slots, may be provided if appropriately sized and spaced so that the liner integrity is not jeopardized.

In order to assist the insertion of the liner into the borehole, a guiding shoe 114 may be provided which is attached via threads 116 thereon to an end 110 of the liner section 94. A tapered forward portion 120 of the shoe 16 enables the shoe to guide the liner 94 down the borehole and to push aside any small amounts of sloughed borehole wall which may have occurred when the drill rod, or steel, 24, is removed from the borehole after the borehole wall cake is established, as will be hereinafter described in greater detail.

A hole 122 through the shoe 114 enables fluids to be circulated therethrough if necessary to assist the insertion of the liner by the pumping of lubricants therethrough, such as, the mud slurry utilized for lubricating the drill and forming borehole cake.

It should be appreciated that the plastic liner 94 may be manually inserted into the borehole, however, with horizontal holes that have been drilled to a depth of many thousand feet, the drill may be utilized to force the liner into the borehole.

Figure 4:
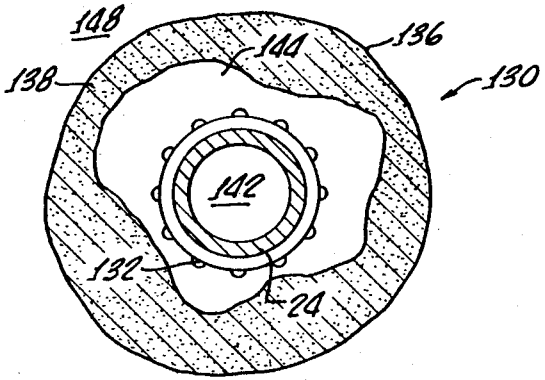
FIG. 4, is a cross-sectional view of a horizontal borehole drilled in accordance with the present invention showing a drill bit therein and illustrating the effects of sloughing, or caving, of the borehole walls; and, FIG. 5, is a cross-sectional view of a horizontal borehole with a gas collection liner inserted therein.

Turning briefly to FIG. 4, there is shown a cross-section 130, of a drilled horizontal borehole with a drill pipe 24 therein and also showing a drill bit profile 132. An outside line 136 shows the outline of the caved borehole whereas the shaded portion 138 shows a wall cake 138 in and on the cave borehole 136, which prevents further caving of the borehole onto the drill steel 24.

In accordance with the present invention, mud slurry is piped through the center 142 of the drill pipe 24 and returns in the annulus 144 between the drill pipe 24 and the borehole 136, with the borehole wall cake 138 building as the water in the mud slurry seeps into the surrounding formation 148, leaving the muds in and on the borehole 136 in the form of the cake 138.

Figure 5:
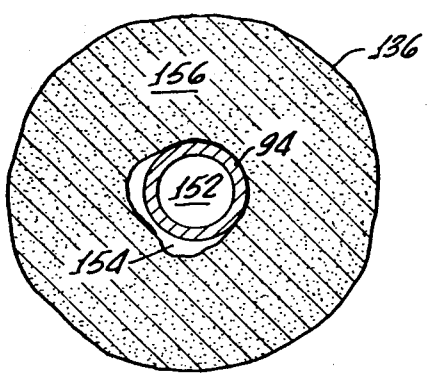

FIG. 5 shows the same cross-section as shown in FIG. 4, after the drill bit 132 and shaft 24 have been removed and the liner 94 inserted. After insertion of the liner, flushing fluid is pumped down the center 152 of the liner and up through the annulus 154, thereby flushing the borehole cake 138, not shown in FIG. 5. Upon flushing of the borehole cake, the borehole 36 may continue to slough and fill in the area 156 between the liner 94 and the original cross-section outline 136 of the borehole.

Generally, the process of the present invention includes drilling a generally horizontal borehole into a subterranean coalseam using a drilling and circulating fluid composed of a mixture of fresh water, drill cuttings, and additives, the additives particularly including Bentonite clays.

As is well known, Bentonite is a soft, porous, plastic, light-colored rock composed mainly of clay minerals and silica. It is commercially available from N. L. Baroid, Houston, Texas.

The Bentonite is used as finely ground powder having a particle size of less than about U.S. mesh 400. When mixed with water, the resultant composition becomes a thixotropic mud.

This thixotropic mud is circulated down the drill string and it serves to clean the hole by flushing cuttings thereout of as well as lubricate the downhole tools and drilling assemblies.

Importantly, the Bentonite thixotropic mud stabilizes the borehole walls by the formation of a semi-stable wall cake around the periphery 136 (see FIG. 4) of the horizontal borehole 130.

This cake formation not only occurs in the vicinity of the freshly drilled coal, but also further uphole along the path of previous drilling in the formation.

The process of the present invention is directed to the drilling of horizontal boreholes in soft coal formations where sloughing, or caving, is a characteristic thereof.

In this type of coal formation, wall stability is very sensitive and may be affected significantly by the drilling fluid utilized during the drilling process. For example, when water itself is utilized as a drilling fluid, it may cause erosion and enhance the amount of sloughing and caving in a borehole, especially when used in sufficient volume to remove both the cuttings and sloughed wall.

The formation of the mud solids cake on and in the walls of the advancing borehole is caused by a seeping, or leaking, of a certain portion of the water, in the drill fluid, into the formation surrounding the borehole. Since the coal formation has a high permeability, the water is accepted thereby but the muds are deposited on and in the pores of the coal formation.

It is apparent that the flow of drilling fluid into the formation is therefore limited by the pressure differential available in the borehole and the permeability of the solid cake formed by the filtration on the borehole walls.

While the use of Bentonite muds for drilling standard vertical oil and gas wells was used at the turn of the century, its application and use in the process of the present invention is unique in that the mud cake is only temporarily deposited on the borehole and thereafter flushed therefrom to enable subsequent collection of methane gas. The liner can be useful as a tool in the flushing of the Bentonite mud cake from the walls and thereafter establishing a path for the methane gas despite subsequent sloughing, or caving, of the borehole after the mud cake is flushed therefrom.

In the present invention, the initial drilling mud is mixed using about 50 pounds of high-yield Bentonite per 100 gallons of fresh water and thereafter adjusted by addition of water or Bentonite to provide a Marsh funnel time of 70 seconds or more which corresponds to a viscosity of between about 40 cP and about 50 cP.

Initially, a pilot hole is drilled as straight as possible to a depth of about 40 feet horizontally or more as required by the anticipated standpipe 26.

Thereafter, a survey of the pilot hole is taken with a single shot survey instrument to ensure accuracy of the path. The Pilot string is withdrawn and replaced with the reamer/hole opener assembly which is then used to open the hole to a size sufficient to insert the standpipe. As is well known in the art, one or more passes may be required depending upon the size of the record standpipe and/or the formation.

The standpipe 26, with required grouting accessories (not shown), is assembled and prepared and the hole is circulated with drilling mud and the reaming assembly is withdrawn.

The standpipe is run to a total depth and pulled back at least one foot to allow connection for the wellhead and grouting clearance of the downhole end of the standpipe. After grouting of the standpipe, the drilling of the borehole is commenced.

During the drilling phase, the return drilling fluid is monitored via valve 50 to determine the proper treatment of the recycled efflux depending upon the circumstances encountered by the drilling. As the drilling advances, the solid drill cuttings are removed from the system, as shown in FIG. 1.

The sampling techniques, as well as the mud gas separator 36 and shaker 38, provide information as to their input with regard to the amount of type of materials being cut by the downhole tools.

Contemporaneously, the fluid being returned by the line 44 to the mud balance system 16 determine the amount and type of solids and additives that are being consumed by the drilling.

A mass balance of the total system is performed to determine the amount of water and Bentonite which are left in the formation or the borehole cake.

It is apparent that the formation of the borehole cake is the most critical item since it is the phenomenon that requires the addition of the Bentonite and additives in order to provide the borehole stability that allows further drilling in the formation and continued circulation in the borehole. It is the loss of borehole stability that requires the fluid handling system as shown in FIG. 1.

Tests to establish the quality and quantity of additives are based on the fluid and drilling response. For example, in the event that the drilling encounters a series of lost circulation zones, or portions of the hole that are not stabilized by the available fluid and/or solids, it is necessary to change the formulation of the drilling fluid. These lost circulation zones are identified by the transducer 30, which indicates the pressure of the drilling fluid in the borehole.

Generally, the basis for changing the fluid makeup is made on the quantity and quality of the return fluid to the mud balance system 16. In normal drilling, the coal formation can usually be maintained by establishing a minimum required for Bentonite content in the recirculated drilling fluid and a maximum coal cutting content in the same fluid. This total solids content in the associated ratio of the Bentonite and the coal are important to the downhole characteristics of the cake formation, as well as the character of the mud to accept additional Bentonite and still perform its intended use as a hole drilling lubricant and a downhole cleaner.

It has been found generally that the recycled slurry should be adjusted so that the level of Bentonite is between about 5 percent by weight and about 25 percent by weight. Preferably, depending upon the coalseams being drilled, the total solids contents of cuttings and Bentonite is below about 10 percent by weight.

However, in testing, it has been determined that the maximum practical limit of 15 percent total solids can be maintained when no additional rheological modifiers, or additives, are used in the recirculated efflux. However, levels as high as 20–25 percent can be used in the solid of the smaller (that is, less than 200 U.S. mesh) with the addition of dispersing agents.

Although dispersing agents may be used to advantage, they are expensive and can cause additional problems with formation damage, which may cause long-term methane gas production problems.

It has been found that for long holes, those over 500 feet, the viscosity of the mud needs to be reduced and, in addition, a defloculant added to prevent bridging of the cuttings in the annulus 144 (see FIG. 4) which causes a blockage in fluid circulation.

The amount of Bentonite used per 300 gallons is about 100 pounds and a defloculant, such as sodium acid as pyrophosphate (known commercially as SAPP) and available from N. L. Baroid, is utilized in the amount of about $\frac{1}{4}$ to $\frac{3}{4}$ of a pound per 100 pounds of Bentonite. This results in a mud having a viscosity of about 10 cP.

Following the completion of the drilling and the formation of the mud cake on the borehole, the drill pipe 24 is withdrawn and the perforated liner 94 inserted in 10 foot coupled sections guided by the shoe 114 is inserted into the borehole.

It has been mentioned hereinbefore that this insertion may be done manually up to a few hundred feet and thereafter it is driven in utilizing the thrust of the drilling machine 12.

After insertion thereof, water is circulated through the center 152 (see FIG. 5) of the liner 94 through the hole 122 of the shoe, as well as the liner holes 96. To facilitate flushing the temporary mud cake out of the horizontal borehole, the water may be carbonated or, in addition, a diluted acid and/or a foaming agent may be added to the water to facilitate the flushing of the Bentonite mud cake.

It is to be appreciated that where other muds capable of forming a cake on the borehole walls are utilized, the flushing of fluid may be any suitable type which facilitates the flushing thereof from the borehole walls.

Alternatively, the borehole cake may be flushed by inserting a non-perforated pipe down the perforated pipe to a preselected distance and thereafter pumping flushing materials to remove the borehole cake.

As hereinbefore mentioned, the flushing materials may include carbonated water or any other suitable chemical reactive for removal of the borehole cake mechanical action such as that provided from a foaming agent also may be utilized to dislodge the borehole cake from the borehole walls. A suitable dilute acid, such as 10 to 15 percent inhibited hydrochloric acid, or 5 percent inhibited hydrofluoric acid, may also be utilized.

Although there has been hereinabove described a specific process for recovering methane gas from subterranean coalseams for the purposes of illustrating the manner in which the present invention may be used to advantage, it should be appreciated that the invention is not limited thereto. Accordingly, any and all modifications, variations or equivalent arrangements, suitable for use in coalseams, which may occur to those skilled in the art, should be considered to be within the scope of the invention as defined in the appended claims.

What is claimed is:

1. A process for recovering methane gas from subterranean coal seams having sloughing, or caving, characteristics, said process comprising the steps of:

drilling a generally horizontal borehole into a subterranean coal seam;

forming a flushable borehole cake on and in the wall of the horizontal borehole as it is drilled;

inserting a perforated liner into the horizontal borehole;

flushing the borehole cake out of the horizontal borehole; and collecting methane gas from the liner.

2. A process for recovering methane gas from a subterranean coalseam having sloughing, or caving, characteristics, said process comprising the steps of:

drilling a generally horizontal borehole into a subterranean coalseam;

pumping a slurry, comprising mud solids and water, into the horizontal borehole as drilling progresses in order to form a temporary mud cake on the horizontal borehole wall, said temporary mud cake being formed as the mud solids are deposited on the horizontal borehole wall as the water seeps into the horizonal borehole wall;

inserting a perforated liner into the horizontal borehole;

flushing the temporary mud cake out of the horizontal borehole;

collecting methane gas seeping into the liner through the perforations therein.

3. The process according to claim 2 wherein the slurry is pumped into the borehole in sufficient quantity to provide lubrication for the drilling process and to carry cuttings, created by the drilling, from the horizontal borehole in the form of an efflux having a total solids content comprising cuttings and mud solids.

4. The process according to claim 3 further comprising the stpes of removing cuttings from the efflux, adjusting the total solids content therein to preselected levels to form a recycled slurry and pumping the recycled slurry into the horizontal borehole.

5. The process according to claim 4 wherein the mud solids comprises Bentonite and the total solids content in the recycled slurry is adjusted to a preselected level of between about 5 percent by weight and about 25 percent by weight.

6. The process according to claim 5 wherein the preselected level of total solids is adjusted to below about 10 percent by weight.

7. The process according to claim 2 wherein the mud solids comprises a thixotropic mud.

8. The process according to claim 2 wherein the mud solids comprise Bentonite.

9. The process according to claim 4 further comprising the step of monitoring the efflux to determine the solids content therein and adjusting the total solids in the recycled slurry in response to the solids content in the efflux.

10. The process according to claim 4 wherein the mud solids content of the recycled efflux is adjusted to enable sufficient mud cake buildup in and/or on the horizontal borehole walls to prevent significant sloughing, or caving, in.

11. The process according to claim 8 further comprising the step of adjusting the solids content of the slurry so that the slurry has a viscosity of between about 40 cP and about 60 cP.

12. The process according to claim 8 further comprising the step of adjusting the solids content of the slurry so that the slurry viscosity decreases as the horizontal borehole is drilled longer.

13. The process according to claim 12 wherein the viscosity of the slurry is maintained between about 40 cP and about 60 cP for the first 500 feet and about 10 cP for drilling thereafter.

14. The process according to claim 2 wherein the slurry comprises mud solids, water and a defloculant.

15. The process according to claim 14 wherein the mud solids comprise Bentonite and the defloculant comprises sodium acid pyrophosphate.

16. The process according to claim 2 wherein the slurry comprises Bentonite and water for about the first 1500 feet of drilling and thereafter comprises Bentonite, water and sodium acid pyrophosphate.

17. The process according to claim 8 further comprising the step of adding sodium acid pyrophosphate to the slurry to prevent bridging of drill cuttings in an annulus defined by the drill shaft and the horizontal borehole.

18. The process according to claim 17 wherein the sodium acid pyrophosphate is added to the slurry during drilling of the borehole to lengths exceeding about 500 feet.

19. A process for recovering methane gas from subterranean coalseams having sloughing, or caving, characteristics, said process comprising the steps of:

drilling a generally horizontal borehole into a subterranean coalseam using a drill pipe;

pumping a slurry, comprising Bentonite mud solids and water, down the center of the drill pipe as drilling progresses in order to both lubricate the driling and to form a temporary mud cake on and in the horizontal borehole wall, said temporary mud cake being formed and the slurry returns to the horizonal borehole opening through an annulus defined by the drill pipe and the borehole wall, and the water therein seeps into the horizontal borehole wall;

inserting a perforated liner into the horizontal borehole;

pumping fluid down the center of the perforated liner in order to flush the temporary mud cake out of the horizontal borehole; and thereafter;

conducting methane gas, collected by the perforated liner, to the horizontal borehole opening.

20. The process according to claim 19 further comprises the step of inserting a non-perforated pipe down the perforated pipe and to a preselected distance and pumping fluid therethrough to flush the temporary mud cake out of the horizontal borehole.

21. The process according to claim 19 wherein the fluid comprises water.

22. The process according to claim 20 wherein the fluid comprises carbonated water.

23. The process according to claim 20 wherein the fluid comprises a dilute acid.

24. The process according to claim 20 wherein the fluid comprises water and a foaming agent.

25. A process for forming a generally horizontal borehole into a subterranean coalseam comprising the steps of:

drilling a generally horizontal borehole into a subterranean coalseam;

forming a flushable borehole cake on and in the wall of the horizontal borehole as it is drilled;

inserting a perforated liner into the borehole for flushing the flushable borehole cake out of the horizontal borehole; and flushing the flushable borehole cake out of the horizontal borehole after drilling is completed.

26. The process according to claim 25 wherein the liner is perforated along the length thereof to enable flushing to occur along the length of the perforated liner.

27. The process according to claim 26 further comprising the step of pumping a slurry, comprising mud solids and water, into the horizontal borehole as drilling progresses in order to form a temporary mud cake on the horizontal borehole wall, said temporary mud cake being formed on the mud solids are deposited on the horizontal borehole wall as the water seeps into the horizontal borehole wall.

* * * * *